US005667434A

United States Patent [19]

Prusaitis et al.

[11] Patent Number: 5,667,434

[45] Date of Patent: Sep. 16, 1997

[54] DENTAL INSTRUMENT SHARPENING DEVICE

[76] Inventors: John H. Prusaitis, 3214 Greenbriar Dr., Glenview, Ill. 60025; Timothy J. Prusaitis, 7012 Church St., Morton Grove, Ill. 60053

[21] Appl. No.: 567,890

[22] Filed: Dec. 6, 1995

Related U.S. Application Data

[62] Division of Ser. No. 299,250, Aug. 31, 1994, Pat. No. 5,487,693, which is a continuation of Ser. No. 6,137, Jan. 19, 1993, abandoned, which is a continuation of Ser. No. 826,139, Jan. 27, 1992, abandoned.

[51] Int. Cl.[6] ..... B24D 15/06

[52] U.S. Cl. ..... 451/552; 451/557; 451/555

[58] Field of Search ..... 451/540, 552, 451/556, 557, 555, 48, 558; 269/309, 310, 317, 296, 254 R

[56] References Cited

U.S. PATENT DOCUMENTS 4,821,462 4/1989 Moore ..... 51/244

5,183,245 2/1993 DiNapoli et al. ..... 269/254 R

*Primary Examiner*—Willis Little

*Assistant Examiner*—Eileen P. Morgan

*Attorney, Agent, or Firm*—Marshall, O'Toole, Gerstein, Murray & Borun

[57] ABSTRACT

In order to achieve precision in sharpening, particularly for dental instruments, a sharpening device includes a base having a generally upwardly extending hand grip portion wherein the base is adapted to be position on a generally horizontal supporting surface. The sharpening device also includes a sharpening stone or the like operatively associated with the base together with a retainer for removably retaining the sharpening stone in at least one angular position relative to the generally horizontal supporting surface.

11 Claims, 2 Drawing Sheets

DENTAL INSTRUMENT SHARPENING DEVICE

RELATED APPLICATION

This is a divisional of U.S. application Ser. No. 08/299,250, filed Aug. 31, 1994, now U.S. Pat. No. 5,487,693, which is a continuation of U.S. application Ser. No. 08/006,137, filed Jan. 19, 1993, now abandoned, which is a continuation of U.S. application Ser. No. 07/826,139, filed Jan. 27, 1992, now abandoned.

FIELD OF THE INVENTION

The present invention is generally directed to sharpening and, more particularly, a sharpening device and method suited for dental instruments and the like.

BACKGROUND OF THE INVENTION

Generally speaking, there has been a variety of sharpening devices and sharpening methods that have been utilized over the years. It is known, for instance, that devices having a cutting edge, such as a knife or instrument, can be sharpened by utilizing a flat abrasive surface such as that found on a sharpening stone. Unfortunately, a significant percentage of people are unable to sharpen a knife or instrument in an effective manner.

In the case of dental instruments, experience demonstrates that approximately 80 to 90 percent are sharpened incorrectly. This occurs primarily due to the fact that there is typically a failure to maintain the proper angle between the face of the instrument and the lateral side between approximately 70 and 80 degrees during the sharpening process. As a result, the angle defined by the cutting edge is often improper, i.e., either too sharp or too dull.

Based upon an investigation into this problem, it has been determined that sharpening an instrument requires a talent known as abstract reasoning. This talent, which is unrelated to intelligence, involves the ability to visualize three dimensional objects in the mind and manipulate such objects without losing perspective. From aptitude tests that evaluate the ability of individuals in abstract reasoning, it has been determined that only approximately 10 percent of the population has this talent.

From the foregoing, it will be apparent that there is a problem of serious proportions in connection with the sharpening of dental instruments. It is well known that a cutting edge of less than 70° is quite sharp, but also very thin, meaning that it wears down quickly and becomes dull and, on the other hand, a cutting edge of more than 80° requires heavy lateral pressure to remove deposits meaning that calculus removal is often incomplete with such an instrument and root planing cannot be done effectively. For these reasons, there has been a continuing need for improved sharpening techniques for dental instruments.

The present invention is directed to overcoming one or more of the foregoing problems and achieving one or more of the resulting objects.

SUMMARY OF THE INVENTION

Accordingly, it is a principal object of the present invention to provide a sharpening device and method insuring a proper cutting edge. It is a further object of the present invention to provide such a device and method for sharpening a dental instrument having a cutting edge defined by a face and lateral side. Additionally, it is an object of the present invention to provide a sharpening device and method requiring a limited degree of abstract reasoning.

To this end, the present invention is directed to a sharpening device having a base including a generally upwardly extending hand grip portion wherein the base is adapted to be positioned on a generally horizontal supporting surface. The sharpening device also includes sharpening means operatively associated with the base in at least one angular position relative to the generally horizontal supporting surface and retention means for removably retaining the sharpening means in that position. Preferably, the sharpening means includes a sharpening stone, and the retention means includes an upper stone rest and a lower stone rest, with the retention means further includes a spring biased retainer lid operatively associated with an upper extreme of the hand grip portion.

In an exemplary embodiment of the present invention, the sharpening device is suited for dental instruments and the base has a generally planar support surface adapted to be positioned on the generally horizontal supporting surface. The hand grip portion is advantageously integral with and extends generally upwardly from the generally planar support surface. Still additionally, the sharpening device preferably includes at least a pair of lower stone rests integral with an angularly inclined surface portion of the generally planar support surface of the base wherein the lower stone rests are positioned so as to support the stone in either of two distinct angular positions. The upper stone rest is advantageously integral with the hand grip portion in upwardly spaced relation to the generally planar support surface with the hand grip portion having an enlarged, contoured and curved hand grip on a generally upwardly extending edge directly opposite the sharpening stone. With the arrangement, the sharpening stone can be placed against either of the lower stone rests to position the sharpening stone within an angular range of between approximately 100° and 110°.

In another respect, the present invention is directed to a method of sharpening a dental instrument having a cutting edge which is defined by a face and a lateral side. The method includes the steps of providing means for supporting a sharpening stone at a preselected angle to a horizontal plane, holding the dental instrument with one hand while holding the supporting means with the other hand, placing the lateral side of the dental instrument into direct contact with the sharpening stone, and orienting the dental instrument such that the face is disposed parallel to the horizontal plane. Thereafter, relative movement is imparted between the dental instrument and the sharpening stone preferably, this is done by holding the supporting means stationery and moving the dental instrument with the face maintained parallel to the horizontal plane.

Other objects, advantages and features of the present invention will become apparent from a consideration of the following specification taken in conjunction with the accompanying drawings.

DETAILED DESCRIPTION OF THE PREFERRED EMBODIMENT

Figure 1:
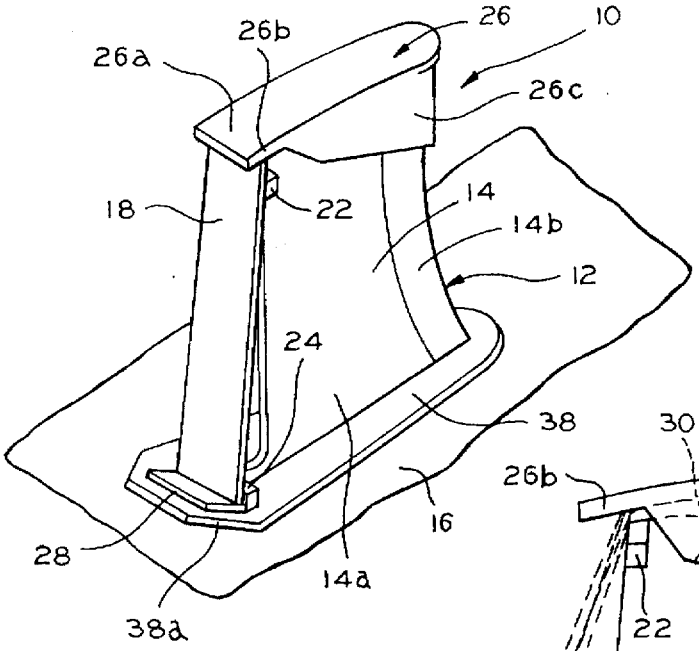
FIG. 1 is a perspective view of a sharpening device in accordance with the present invention.

In the illustrations given, and with reference first to FIG. 1, the reference numeral 10 designates generally a sharpening device in accordance with the present invention. The sharpening device 10 includes a base 12 having a generally upwardly extending hand grip portion 14 wherein the base 10 is adapted to be positioned on a generally horizontal supporting surface 16. Sharpening means, such as a sharpening stone 18, is operatively associated with the base 12 in at least one angular position relative to the generally horizontal supporting surface 16. The sharpening device 10 also includes retention means 20 for removably retaining the sharpening stone 18 in at least one angular position relative to the generally horizontal supporting surface 16. In the illustrated embodiment, the retention means includes an upper stone rest 22, a lower stone rest 24, and a spring biased retainer lid 26 operatively associated with an upper extreme of the hand grip portion 14.

As will be appreciated, the lower stone rest 24 is integral with the base 12 at a point generally adjacent to the generally horizontal supporting surface 16. In a highly preferred embodiment, the sharpening device 10 includes at least a pair of lower stone rests such as 24 and 28 positioned so as to support the sharpening stone 18 in either of two distinct angular positions (see FIG. 2) relative to the generally horizontal supporting surface 16. Still additionally, the upper stone rest 22 is integral with the hand grip portion 14 at a point spaced well above the generally horizontal supporting surface 16.

Figure 2:
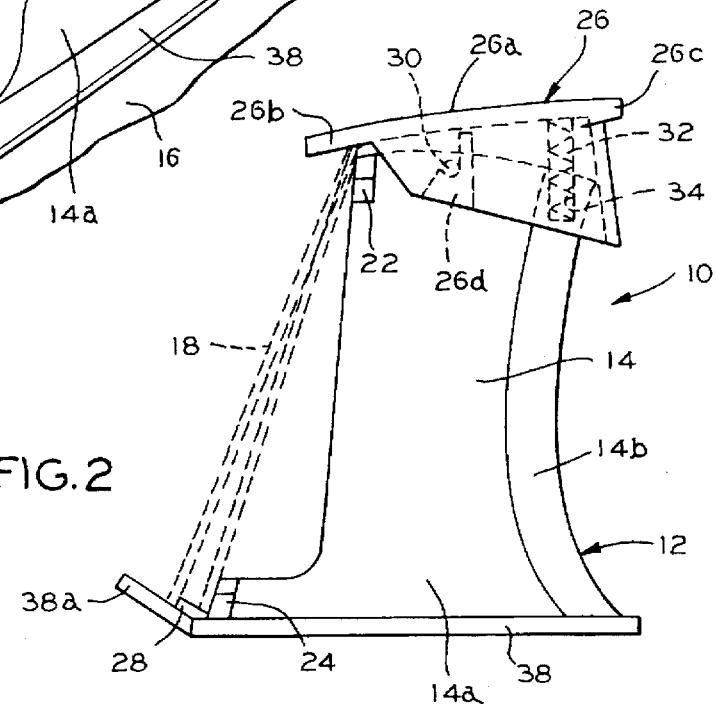
FIG. 2 is a side elevational view of the sharpening device of FIG. 1.

As will be appreciated by referring to FIG. 2, the retainer lid 26 is pivotally mounted to the hand grip portion 14 at the upper extreme for normal engagement with the sharpening stone 18. It will be appreciated that the retainer lid 26 has a generally planar upper surface **26*a* including a forward retainer edge 26*b* for normal engagement with the sharpening stone 18. The retainer lid 26 also will be seen to have a generally U-shaped skirt portion 26*c* depending from the generally planar upper surface 26*a*. It will also be appreciated that a pair of retainer hooks such as 26*d* are supported by the skirt portion 26*c*. Still referring to FIG. 2, the retainer hooks such as 26*d* pivotally engage a corresponding pair of posts such as 30 on the hand grip portion 14 of the base 12**.

As will be appreciated, the retainer hooks such as **26*d* are intermediate the forward retainer edge 26*b* and a rear edge 26*e* of the retainer lid 26. A spring 32 is disposed between the hand grip portion 14 of the base 12 and the generally planar upper surface 26*a* of the retainer lid 26 adjacent the rear edge 26*e* thereof. More specifically, the hand grip portion 14 of the base 12 preferably has a hole 34 in which the spring 32** is disposed substantially as shown in FIG. 2.

Figure 3:
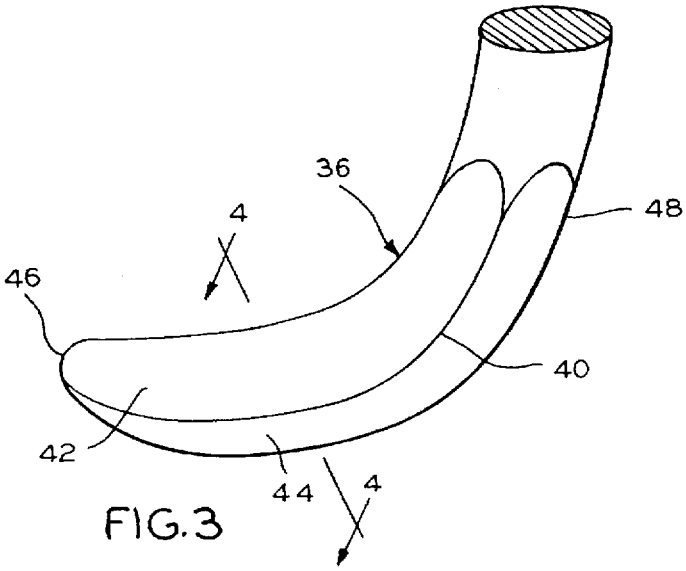
FIG. 3 is a partial perspective view of a dental instrument sharpened by the sharpening device of FIG. 1.
Figure 4:
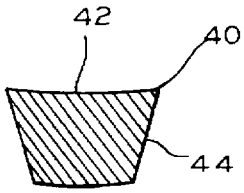
FIG. 4 is a cross-sectional view taken along the line 4—4 of FIG. 3.

While the sharpening device 10 is well suited for many applications, it is particularly advantageous for sharpening a dental instrument 36 (see FIG. 3). In a most highly preferred embodiment, the sharpening device 10 is formed such that the base 12 includes a generally planar support surface 38 adapted to be positioned on the generally horizontal supporting surface 16 wherein the hand grip portion 14 is integral with and extends generally upwardly from the generally planar support surface 38 will be understood to be in an immediately adjacent parallel plane to the generally horizontal supporting surface 16.

Referring to FIGS. 1 and 2, the lower stone rests 24 and 28 are integral with an angularly inclined surface portion **38*a* of the generally planar support surface 38 of the base 12 and the upper stone rest 22 is integral with the hand grip portion 14 in upwardly spaced relation to the generally planar support surface 38. As previously suggested, the lower stone rests 24 and 28 are positioned so as to support the sharpening stone 18 in either of two distinct angular positions relative to the generally planar support surface 38** within an angular range of between approximately 100° and 110°.

Advantageously, the lower stone rest 24 will support the sharpening stone 18 at an angle of 100° while the lower stone rest 28 will support the sharpening stone 18 at an angle of 110°, whereby the sharpening device 10 is suited for sharpening a curet in the former case and a scaler in the latter case, respectively.

As will be appreciated from FIGS. 1 and 2, the hand grip portion 14 of the base 12 is generally planar as at **14*a* and is also generally perpendicular to the generally planar support surface 38. It will also be appreciated that in the preferred embodiment, the sharpening stone 18 is a generally planar rectangle. With this arrangement, the hand grip portion 14 of the base 12 has an enlarged, contoured and curved hand grip 14*b* on a generally upwardly extending edge directly opposite the sharpening stone 18**.

Figures 5, 5A:
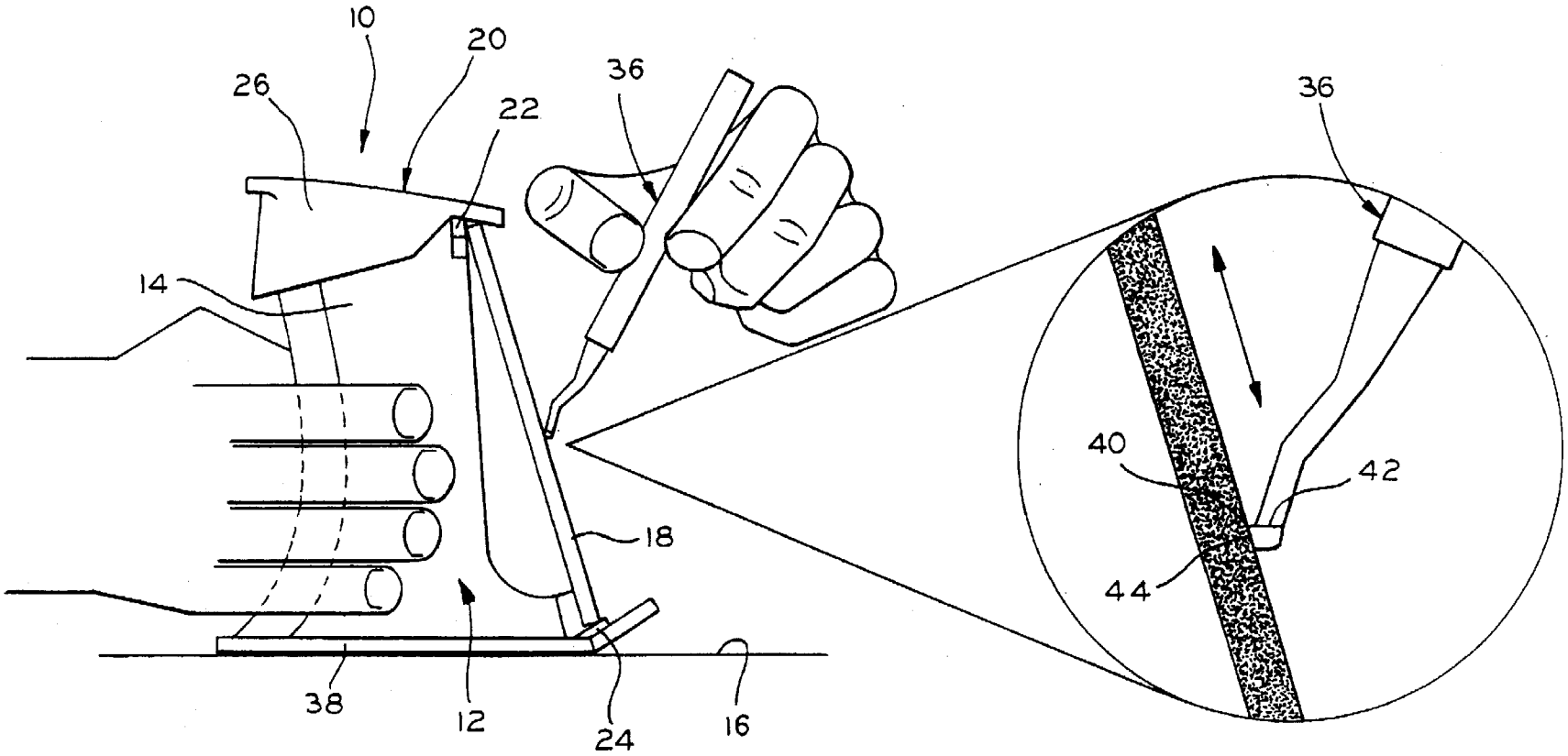
FIG. 5 is a side elevational view of the sharpening device of FIG. 1; and enlarged detail balloon showing use of the sharpening device of FIG. 1.

In another respect, and as illustrated in FIG. 5 and FIG. 5A, the present invention is directed to a method of sharpening a dental instrument such as 36 having a cutting edge 40 defined by a face 42 and a lateral side 44. The method includes the steps of providing means for supporting a sharpening stone 18 at a preselected angle to a horizontal plane and holding the dental instrument such as 36 with one hand while holding the supporting means with the other hand, placing the lateral side 44 of the dental instrument such as 36 into direct contact with the sharpening stone 18 and orienting the dental instrument such as 36 such that the face 42 is disposed parallel to the horizontal plane. With this accomplished, the present invention achieves the objective of sharpening a dental instrument such as 36 by imparting relative movement between the dental instrument such as 36 and the sharpening stone 18.

As previously suggested, the preselected angle or angles at which the sharpening stone 18 is supported is within an angular range of between approximately 100° and 110°. It is possible in this connection for the supporting means, such as the sharpening device 10, to be held stationery while the dental instrument is moved in an up and down motion relative to the sharpening stone 18 or, alternatively, the dental instrument such as 36 may be moved in a circular motion relative to the sharpening stone but, in either case, the dental instrument such as 36 is preferably moved with the face 42 maintained parallel to the horizontal plane. In any event, the sharpening method advantageously includes the step of moving the dental instrument such as 36 so as to follow contours of the lateral side 44 thereof from the toe 46 to the heel 48.

As will be appreciated, the dental instrument illustrated is a curet 36. It is advantageous to sharpen the curet 36 by first positioning the sharpening stone 18 so as to be in contact with the lower rest 28 and the upper rest 32. This is accomplished by depressing the retainer lid 26 so as to overcome the biasing force of the spring 34 to temporarily disengage the front edge **26*b* from engagement with the sharpening stone 18 following which the retainer lid 26 may be released to once again secure the sharpening stone 18 in the desired position, i.e., resting against the upper rest 22 and the lower rest 28. With this accomplished, the curet 36 may be held in the manner of a spoon containing a liquid wherein the face 42** is parallel to a horizontal plane.

As will be appreciated, the duplication of this action is within the personal experience of nearly everyone. In other words, it is a common experience for anyone who has taken liquid medicine to hold a spoon in precisely the same manner as is required to hold the curet 36 in the correct position for sharpening the lateral side 44 so as to form a cutting edge with the face 42 of 70°. As a result, the requirement to possess the talent of abstract reasoning is eliminated by utilizing the invention herein.

In other words, the angle necessary for proper sharpening has been placed into a perspective where it is easily visualized even without the ability of abstract reasoning.

In use, the dental instrument such as 36 is held in the dominant hand and the hand grip **14*b* is held with the other hand. The dental instrument such as 36 (or the sharpening device 10) is then turned during sharpening to follow the contours of the lateral side 44 so as to ensure retaining the original shape of the face 42 while sharpening. After every few strokes, the cutting edge 40** is tested against a plastic test rod.

More specifically, the cutting edge 40 is utilized to scale the rod as if it were a tooth. This action provides a good indication of the sharpness of the cutting edge 40. Also, by scaling the rod, any burr or wire edge that may have formed during sharpening will be removed.

With the present invention, the sharpening process is simplified so that a far greater percentage of people can sharpen effectively. Also, the sharpening device permits easy sharpening stone replacement as well as substitution of a wide variety of abrasives in an apparatus that is easy to assemble and disassemble and the angularly inclined portion **38*a* of the generally planar support surface 38 and the front edge 26*b* of the retainer lid 26 serve to reduce the risk of personal injury while sharpening by forming stops with the only hand that could be cut being positioned considerably distant from the sharpening stone 18 by reason of the location of the hand grip portion 14*b***. Still further, the sharpening device can be used chair side in a dental office by forming it of stainless steel so as to be fully sterilizable.

While in the foregoing there has been set forth a preferred embodiment of the invention, it will be appreciated that the details herein given may be varied by those skilled in the art without departing from the true spirit and scope of the appended claims.

We claim:

1. A sharpening device for a dental instrument having a handle and a tip formed to have a cutting edge defined by a face and lateral side, comprising:

a base supporting a sharpening stone and having a generally planar support surface to be placed in a fixed position on a generally horizontal surface to cause said sharpening stone to be disposed in at least two distinct fixed angular positions relative to said generally planar support surface and also having a hand grip portion integral with and extending generally upwardly from said generally planar support surface;

said base including stone retention means for removably supporting and retaining said sharpening stone in either of said two distinct fixed angular positions relative to said generally planar support surface such that said hand grip portion can be held with one hand and said handle of said dental instrument can be held with the other hand while placing said lateral side of said tip of said dental instrument into direct contact with said sharpening stone with said tip of said dental instrument oriented such that said face is disposed parallel to said generally horizontal surface and in a horizontal plane without regard to the angle of said handle relative to said sharpening stone for thereafter imparting relative movement between said tip of said dental instrument and said sharpening stone to sharpen said dental instrument.

2. The sharpening device of claim 1 wherein said stone retention means includes a spring biased retainer lid operatively associated with an upper extreme of said hand grip portion.

3. The sharpening device of claim 2 wherein said retainer lid is pivotally mounted to said hand grip portion at said upper extreme for engagement with said sharpening stone.

4. The sharpening device of claim 2 wherein said retainer lid has a generally planar upper surface including a forward retainer edge for engagement with said sharpening stone.

5. The sharpening device of claim 1 wherein said stone retention means includes an upper stone rest and a lower stone rest and also includes a spring biased retainer lid operatively associated with said hand grip portion adjacent said upper stone rest.

6. The sharpening device of claim 5 wherein said lower stone rest is integral with an angularly inclined surface portion of said generally planar support surface of said base, and wherein said upper stone rest is integral with said hand grip portion in upwardly spaced relation to said generally planar support surface.

7. The sharpening device of claim 6 including at least a pair of lower stone rests positioned so as to support said stone in either of said two distinct fixed angular positions relative to said generally planar support surface within an angular range of between approximately one hundred and one hundred ten degrees.

8. The sharpening device of claim 5 wherein said retainer lid is pivotally mounted to said hand grip portion at said upper extreme for normal engagement with said stone, and wherein said retainer lid has a generally planar upper surface including a forward retainer edge for engagement with said stone.

9. The sharpening device of claim 8 wherein said retainer lid has a generally U-shaped skirt portion depending from said generally planar upper surface, and having a pair of retainer hooks supported by said skirt portion for pivotally engaging a corresponding pair of posts on said hand grip portion of said base.

10. The sharpening device of claim 9 wherein said retainer hooks are intermediate said forward retainer edge and a rear edge of said retainer lid and having a spring disposed between said hand grip portion of said base and said generally planar upper surface of said retainer lid adjacent said rear edge thereof.

11. The sharpening device of claim 5 wherein said hand grip portion of said base is generally planar and perpendicular to said generally planar support surface, said stone is a generally planar rectangle, and said hand grip portion of said base has an enlarged, contoured and curved hand grip on a generally upwardly extending edge directly opposite said stone.

* * * * *

UNITED STATES PATENT AND TRADEMARK OFFICE

CERTIFICATE OF CORRECTION

PATENT NO. : 5,667,434

DATED : September 16, 1997

INVENTORS : Prusaitis et al.

It is certified that error appears in the above-identified patent and that said Letters Patent is hereby corrected as shown below:

column 2, line 66, before "enlarged" please insert --Fig. 5A is an--; and

Signed and Sealed this

Twenty-third Day of December, 1997

Bruce Lehman

*Attest:*

BRUCE LEHMAN

*Attesting Officer*

*Commissioner of Patents and Trademarks*